United States Patent [19]

Teti, Jr. et al.

[11] 4,064,594

[45] Dec. 27, 1977

[54] TOOL BOX HANDLE

[75] Inventors: Joseph A. Teti, Jr., Merion; Peter A. Peroni, Pottstown, both of Pa.

[73] Assignee: LaFrance Precision Casting Company, Philadelphia, Pa.

[21] Appl. No.: 740,976

[22] Filed: Nov. 11, 1976

[51] Int. Cl.[2] ..... A47B 95/02

[52] U.S. Cl. ..... 16/125; 220/94 R

[58] Field of Search ..... 16/110 R, 125, 114 R, 16/126, DIG. 24, DIG. 25, DIG. 28, DIG. 40; 190/57, 58 A; 220/94 R; 229/52 A, 52 AC

[56] References Cited

U.S. PATENT DOCUMENTS 3,727,265 4/1973 Camp ..... 16/125

*Primary Examiner*—Louis K. Rimrodt

*Attorney, Agent, or Firm*—Connolly and Hutz

[57] ABSTRACT

A handle for tool boxes and the like includes an elongated strap having a pair of lugs at each end thereof each pair of which slides in lug nests in a respective end cover. The end covers are of thickened construction in the path of inward sliding motion to provide greater load carrying capability. The end covers include mounting structure for simplifying the assembly of the handle on the tool box or the like.

41 Claims, 18 Drawing Figures

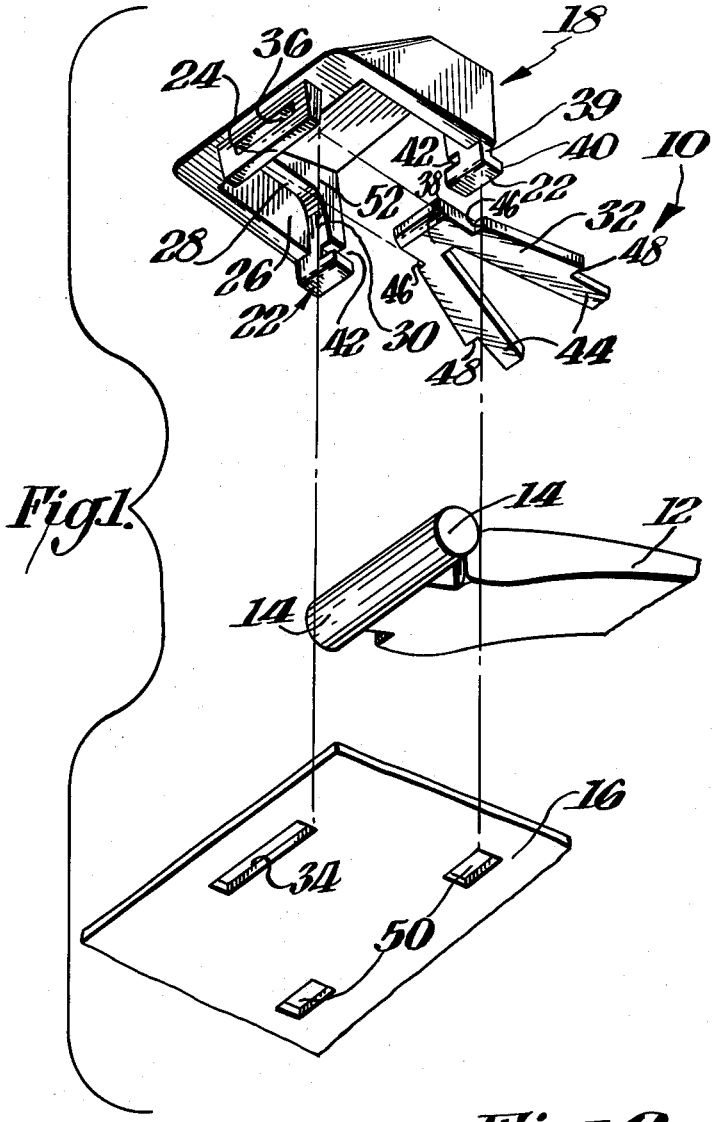
Fig.1.
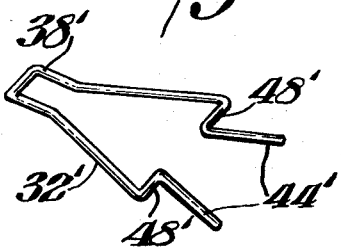
Fig.5A.
Fig.2.
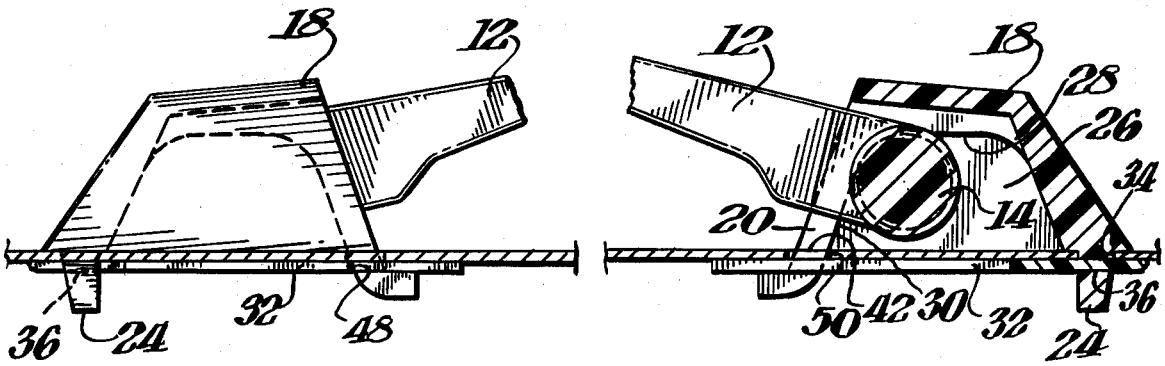

TOOL BOX HANDLE

BACKGROUND OF THE INVENTION

Handles have been used from time immemorial to facilitate the carrying of various types of objects. This invention while having application to various diverse fields is particularly adapted for use with tool boxes or the like. With such devices it would be desirable to utilize mass production techniques for the assembly thereof. Accordingly, ideal handle structure should lend itself to such techniques by requiring a minimum number of parts and by being arranged in such a manner as to facilitate their assembly. It would further be desirable, particularly where the tool boxes and the like are used for carrying heavy loads, that the handles likewise be capable of functioning under these conditions.

Various handle structure are known to the prior art. Exemplary of these are U.S. Pat. Nos. 2,106,911; 2,332,765; 2,987,151; 3,219,160; 3,289,798; 3,431,586 and 3,566,436 and British patent specification Nos. 329,504; 330,114 and 333,660. In particular British patent specification Nos. 330,114 and 333,660 are pertinent to this invention. These patents disclose handle arrangements wherein the handle is ordinarily in the flat condition with each end of the handle being provided with transverse strips or trunnions which slide in respective housings or bearing members so that upon grasping the handle to lift the portable article the handle assumes a curved extended condition by the sliding movement of the end strips or trunnions.

Although such prior art arrangements as indicated above, have various advantages, they also have drawbacks. For example, with mass production techniques it would be preferable to avoid the necessity of using screws, bolts, nuts or other threaded fasteners as are required by British patent specification Nos. 333,660; 330,114. Likewise it would also be preferable to provide an arrangement which compensates for the heavy load requirements in place of sheet metal housings or bearing members.

SUMMARY OF THE INVENTION

An object of this invention is to provide a handle structure which fulfills the requirement of mass production techniques.

A further object of this invention is to provide such a handle structure which has improved load carrying capability.

A still further object of this invention is to provide such a handle structure which can be conveniently assembled preferably without the use of threaded fasteners.

A yet further object of this invention is to provide such a handle structure wherein the components may be arranged as a unit during preassembly to minimize the possibility of parts or components being misplaced and to facilitate their later final assembly.

In accordance with this invention a handle for tool boxes and the like includes an elongated strap having a pair of lugs at each end thereof, each pair of which slides in lug nests in a respective end cover. The end covers are of thickened construction in the path of inward sliding motion to provide greater load carrying capability. The end covers include mounting structure for simplifying the assembly of the handle on the tool box or the like.

The end covers may be provided with keepers of particular configuration for fitting into corresponding holes or openings in the tool box panel and then locked in place by various types of fasteners.

The components may be arranged as a unit during preassembly by securing the fasteners to the end covers to lock the lugs therein and later removing the fasteners immediately prior to assembly. Alternatively the end covers may be bowed at their lower ends so and the lugs would have rounded outer faces whereby the lugs could be snapped into the end covers and then prevented from falling out.

THE DRAWINGS

FIG. 1 is a perspective assembly view of a handle in accordance with this invention;

FIG. 2 is a side elevation view partly in section of the handle structure of FIG. 1 in assembled condition;

FIG. 5A shows a modified form of fastener;

DETAILED DESCRIPTION

Figure 6:
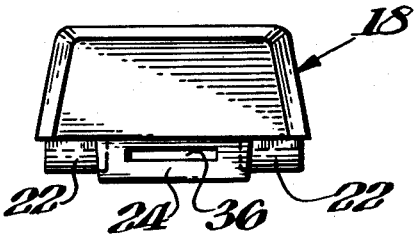
FIG. 6 is a rear elevation view of the end cover shown in FIGS. 1–2.
Figure 3:
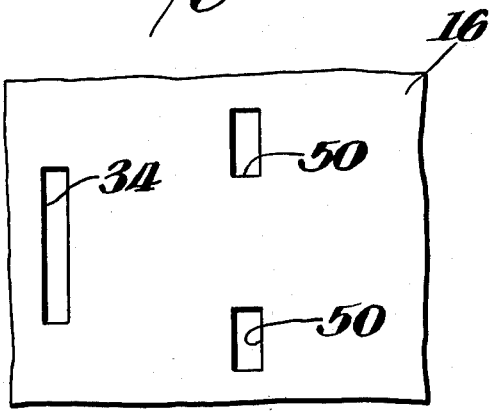
FIG. 3 is a top plan view of a portion of the panel of the tool box or the like shown in FIG. 1.

FIG. 1 illustrates one embodiment of the handle 10. As indicated therein, the handle comprises a generally flat elongated strap 12 which is provided with a pair of lugs 14, 14 transversely arranged at each end thereof. Strap 12 and lugs 14 may be integrally molded from a suitable plastic or may be made from other material such as leather, metal or the like with the strap integral with lugs 14, 14 or simply attached thereto. In its preferred form strap 12 is made of a springy material which tends to assume a generally flat horizontal shape but which may be bowed upwardly upon being lifted by a user and which will then again resume its flat condition after pressure is released. Strap 12 is to be mounted to a panel 16 of a tool box or any other type of housing which is intended to be portable. The handle elements include an end cover 18 for each end of strap 12. The respective end covers 18, 18 are identical with each other and each forms a housing in cooperation with panel 16 for capturing a respective pair of lugs 14, 14. Each such housing has an open face 20 disposed toward the opposite end cover and the housings are otherwise closed. Corner keepers 22, 22 and end keeper 24 are formed on each of the end covers to facilitate securement to panel 16 as later described. The keepers may be integrally molded with end covers 18 from, for example, a suitable plastic material. If desired, the keepers and end covers may be made of any other suitable materials and may be separate elements or be in integral form. Each end cover 18 includes a pair of opposed lug nests or recesses 26 in its side walls parallel to strap 12 and spaced apart a distance slightly larger than the distance between the opposite faces of lugs 14, 14 so that the lugs may readily slide in the lug nests. As illustrated in FIG. 1 the lug nests are formed with an upper wall 28 which slopes downwardly and merges into a front wall 30 at the open end 20 of end cover 18. Upper walls 28 and front walls 30 thus provide abutments in the path of lugs 14, 14 to maintain the lugs housed within the end covers. As later described, the strap 12 and its lugs 14 and the end covers 18 are secured to panel 16 by a suitable fastener such as fastener 32 of FIGS. 1–2 and 4–5.

Figure 5:
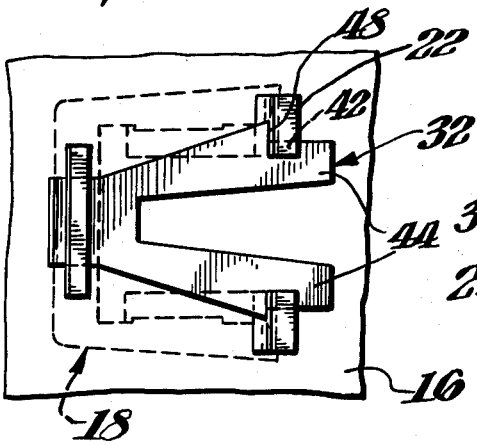
FIGS. 4–5 are bottom plan views showing different phases of assembly of the handle structure shown in FIGS. 1–2.
Figure 4:
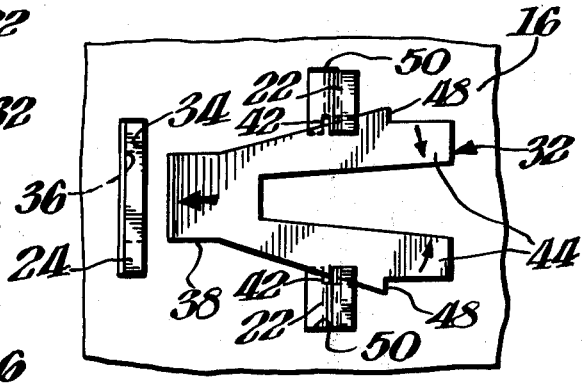

As best shown in FIGS. 1 and 6, end keeper 24 tapers downwardly and is dimensioned to fit within a corresponding opening 34 in panel 16. An elongated horizontal slot 36 is formed in keeper 24 for receiving the leading end 38 of fastener 32. Lead end 38 has a pointed face to facilitate entering slot 36. Each of keepers 22, 22 is generally L-shaped having a downwardly depending generally vertical leg 39 and terminating in a horizontal leg 40. Slots or notches 42 are formed in vertical walls or legs 39 of each keeper 32, 32 disposed toward each other for receiving the outer ends of arms 44, 44 of fastener 32. Fastener 32 is also provided with notches or recesses forming shoulders 46, 46 and 48, 48. If desired lead end 38 may simply taper outwardly forming gentle shoulders without abrupt shoulders as shown in FIGS. 4–5. Fastener 32 is generally arrowhead shaped made in a blade-like flat configuration of a deflectable material such as suitable plastic or a metal whereby arms 44, 44 may be squeezed toward each other and then returned to their normal condition upon release of squeezing action.

FIGS. 1 and 4–5 illustrate the manner of assembling the handle structure. Lugs 14, 14 are first disposed into lug nests 26, 26 through the open bottom of end cover 18. Each end cover 18 is tilted upwardly so that the horizontal extensions or legs 40, 40 of each keeper 22 may be inserted in corresponding openings 50, 50 of panel 16. Each keeper 18 is then pivoted downwardly until the central leg or keeper 24 enters slot 34 with the vertical portions 39, 39 of the corner legs or keepers 22 being disposed in slots 48, 48. Keeper 18 is then in a flat position. Fastener 32 is next inserted into the keepers from below panel 16. This is accomplished by deflecting arms 44, 44 toward each other (FIG. 4) with the fastener 32 being in the plane of slot 36 and notches 42, 42. Arms 44, 44 are deflected a sufficient amount so that they may be passed between end legs 22, 22 until lead end 38 is inserted into slot 36 with its shoulders 46, 46 (FIG. 1) or corners (FIG. 5) preventing lead end 38 from passing too far through slot 36 of keeper 24. The squeezing action is then terminated and as shown in FIG. 5 arms 44, 44 move toward their original unstressed condition fitting into notches or grooves 42, 42 with shoulders 48, 48 abutting against corner legs 22, 22.

Each end cover 18, 18 is particularly designed to provide greater load carrying capability over prior arrangements wherein the handle houses were made of uniform thickness from, for example, sheet metal. In this respect the end covers are of thickened construction in the portions which are in the path of sliding motion of the lugs as the handle is being lifted. This thickened construction is accomplished in part by inclining the upper outer wall of cover 18 upwardly toward its open face 20 while that end face is in turn outwardly inclined. Similarly, the lug nests faces 28, 30 slope downwardly and have a rounded corner with a thickened area 52 thus resulting at the upper corner where the greatest load is applied upon lifting the handle.

Fastener 32 need not be in plate-like form. FIG. 5A for example shows the same type of fastener may be a blade of flat-like form made of bent wire such as piano wire. In FIG. 5A like reference numerals are used for like parts as with fastener 32 but with a prime thereafter.

Figure 7:
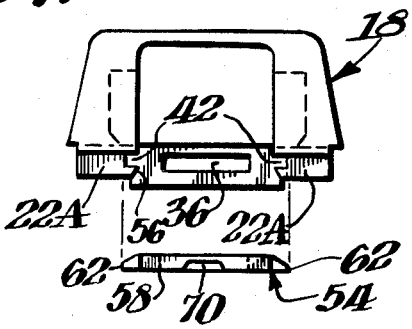
FIG. 7 is an end elevation view of an end cover and fastener in accordance with a further aspect of this invention.
Figure 8:
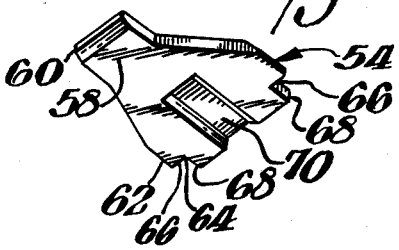
FIG. 8 is a perspective view of the fastener shown in FIG. 7.

FIGS. 7–8 illustrate another form of this invention wherein an alternate fastener 54 is utilized. As indicated therein end cover 18 is of generally the same construction as previously described and accordingly corresponding reference numerals are used for like parts. In this embodiment, however, the corner legs 22A, 22A are bevelled to form tapered edges 56. Fastener 54 is formed of a suitable material in plate-like blade form having a lead end 58 with a pointed lead face 60 similar to the pointed lead face of fastener 32 for being inserted into slot 36 of keeper 24. The outer edges 62 of fastener 54 are notched to create recessed corners 64, 64 with spaced stop shoulders 66, 66 abutting against corner legs 22A, 22A. Blade 54 is inserted by first inserting lead end 58 into slot 36 of keeper 24 and then snapping the parallel arms 68, 68 upwardly into notches 42, 42 over bevelled edges 56, 56. This snapping action is facilitated by forming the trailing end of fastener 54 with a pair of parallel arm sections which may be completely separate from each other similar to a slingshot or may be joined by a thin web 70 as illustrated.

Figure 9:
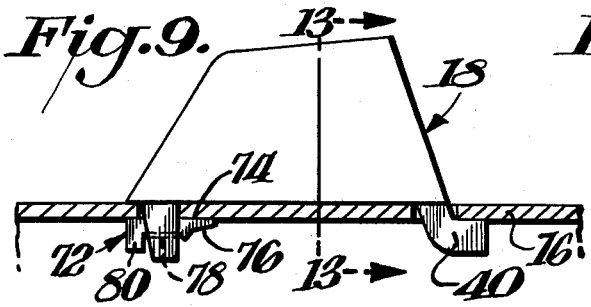
FIG. 9 is a side elevation view partly in section of a handle construction in accordance with a further aspect of this invention.

FIG. 9 illustrates a further form of this invention which includes yet another fastener 72. As illustrated therein, the same general form of end covers 18, previously described, may be utilized therein but fastener 72 is inserted only into keeper 24. To accomplish this, fastener 72 includes a horizontal upper surface 74 with a tapered leading edge or end 76 and with a channel 78 of a width about the same as or slightly greater than the width of slot 36. The opposite end 80 of fastener 72 is of thickened construction. In this embodiment end cover 18 is fit into panel 16 as previously described and fastener 72 is then inserted from below panel 16 with its lead end 76 passing through slot 36 until slot 36 snaps over channel 78. By close dimensioning with respect to the thickest portion of the lead end 76 and the thickness of slot 36 fastener 72 is thereby firmly mounted in place. The opposite end of end cover 18 is prevented from being dislodged by horizontal arms or extensions 40 being disposed against panel 16.

Figure 10:
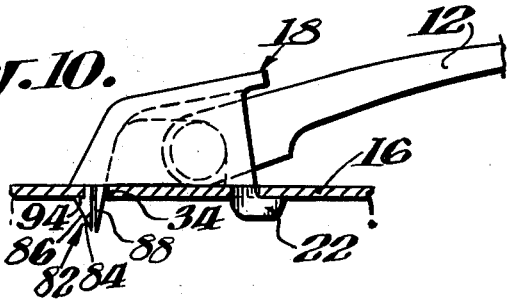
FIG. 10 is a side elevation view partly in section of a yet further handle structure in accordance with this invention.
Figure 12:
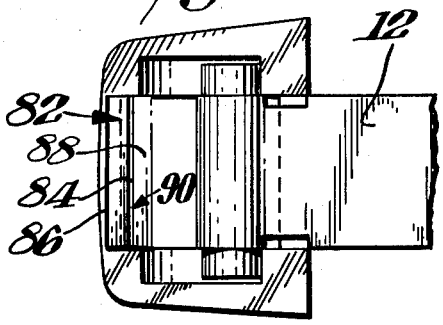
FIG. 12 is a bottom plan view of the handle shown in FIG. 10.
Figure 11:
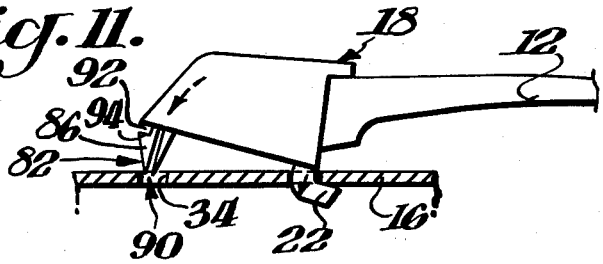
FIG. 11 is a side elevation view partly in section showing a stage of assembly of the handle construction shown in FIG. 10.

In the three prior embodiments the handle is assembled by applying a fastener from within the tool box or below panel 16. FIGS. 10–12, however, show another form of this invention which does not require a separate fastener. As indicated therein end cover 18 is of generally the same construction as previously described but differs with respect to its central leg or keeper. In this respect the central leg or keeper 82 is generally triangularly shaped in cross-section and includes a slightly inclined generally vertical slot 84 creating a pair of bifurcated arms 86, 88 which have remote edges tapering away from each other to provide a leading end 90. A notch 92 extends across arm 86 of sufficient thickness to accommodate panel 16. As shown in FIG. 11, the end cover is assembled by first inserting corner legs or keepers 22, in the manner previously described, and then swinging end cover 18 downwardly toward a flat condition against panel 16 with leading edge 90 fitting into hole 34 of panel 16. Because of slot 84, fiburcated arms 86, 88 are deflected toward each other until lower surface 94 of notch 92 has passed below panel 16. The handle is then in the condition shown in FIG. 10 with arms 86, 88 returning to their natural condition and with the end cover thus locked to panel 16 by the panel being captured in notch 92.

In accordance with a further aspect of this invention the various handle components may be secured together during preassembly to form a unit thus minimizing the possibility of misplacing parts prior to assembly. In this respect with the embodiment illustrated in FIGS. 1–6 fastener 32 may be temporarily assembled in the manner previously described prior to any assembly on panel 16. Since the fastener 32 spans the lower end of cover 18 lugs 14, 14 are prevented from being withdrawn from the end covers and thus the fasteners, end covers and strap are held together as a single unit which greatly lends itself to mass production techniques where such preassembled units may be stored for later assembly on to various types of tool boxes and the like. At the time of assembly fastener 32 is simply detached from its end cover and later reattached by inserting the keepers through the holes in panels 16 and then reassembling fastener 32.

Similarly, the same preassembly is possible by use of fastener 54. The fastener 54 likewise spans the open lower end of end cover 18 and thus would prevent lugs 14, 14 from being withdrawn from the end covers.

Figure 13:
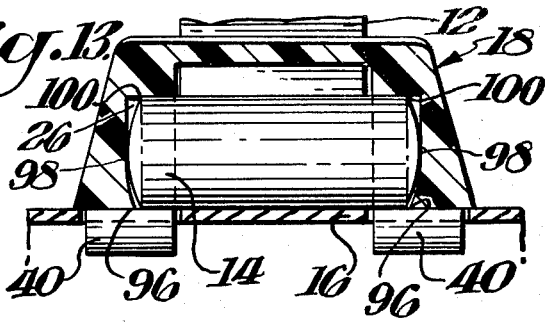
FIG. 13 is a cross-sectional view taken through FIG. 9 along the line 13—13.

FIG. 13 shows a further embodiment of this invention which effectuates the concept of providing the preassembled unit and does not rely upon any particular type of fastener and is particularly useful where the fasteners do not span the open bottom of end cover 18. Such forms are illustrated in the embodiments of FIG. 9, of FIGS. 10–12, of FIGS. 14–15 and of FIGS. 16–17, although it may be used with the prior embodiments. In FIG. 13 lug nests 26 are inwardly bowed and are separated by a distance slightly less than the maximum distance between opposite faces 98, 98 of lugs 14, 14. Faces 98, 98 in turn have corners 100, 100 at their upper and lower ends spaced from each other a distance less than the distance between bowed ends 96, 96. The rounded faces 98 thus provide camming surfaces so that upon insertion of the lugs into the end covers, corners 100, 100 readily pass by ends 96, 96 and the gradually increasing distance between end faces 98, 98, causes sides or lug nests 26, 26 to slightly deflect until the lugs have passed by bowed ends 96, 96. Lugs 14, 14 are thereby prevented from being accidentially withdrawn from the lower open end of end cover 18 unless there is a great force applied to effectuate such withdrawal. The rounded cam faces 98, 98, however, also permit the lugs to be withdrawn should such be necessary.

The various embodiments described above provide a handle structure which offers quick assembly with greater load carrying capacity and which minimizes the assembly line tooling. Thus the inventive handle structure provides more beneficial cost and load capability factors. Moreover, by utilizing generally the same structure with different types of fasteners various alternate manners of assembly are provided. With the aforedescribed arrangements the lugs are captured between the lug nests and panel and move generally parallel to the panel when the handle is lifted. The end covers cushion the lift and direct most of the load to the strongest part of the end covers. Obviously, various modifications are possible in light of these teachings. For example, the same basic structure could be utilized with different length handles by spacing the sets of panel holes appropriately apart. Additionally, the arrangements may be used with panels of various thicknesses.

Figure 15:
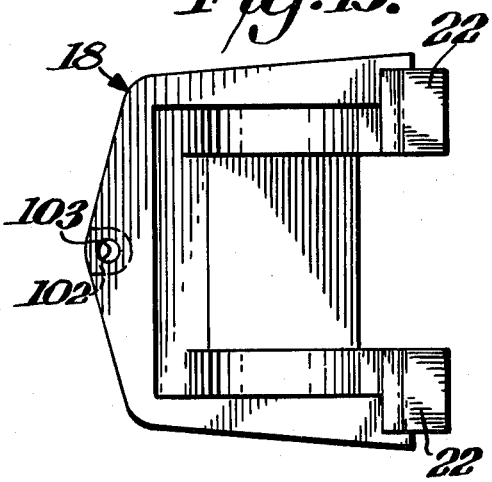
FIG. 15 is a bottom plan view of the handle structure shown in FIG. 14.
Figure 14:
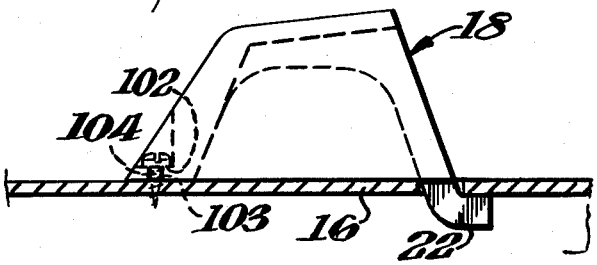
FIG. 14 is a side elevation view partly in section of handle structure in accordance with another embodiment of this invention.

The previous embodiments are particularly advantageous in that they eliminate the need for screws or other threaded fasteners such as employed by the prior art. Such fasteners, however, may be incorporated in accordance with other aspects of this invention particularly where thick panels are utilized. FIGS. 14–15, for example, show an arrangement wherein the end cover 18 includes corner legs 22 but the end leg or keeper is omitted. In its place is a flattened section 102 through which a threaded fastener 104 is inserted through hole 103 for securement to or through panel 16.

Figure 17:
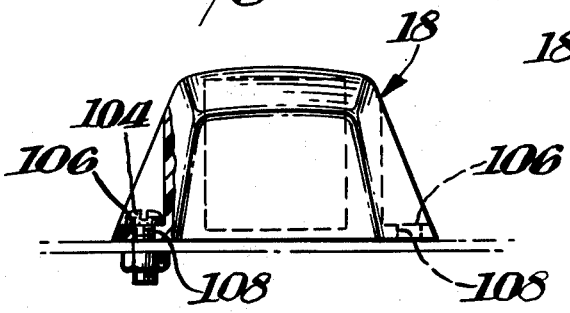
FIG. 17 is a side elevation view of the end cover shown in FIG. 16.
Figure 16:
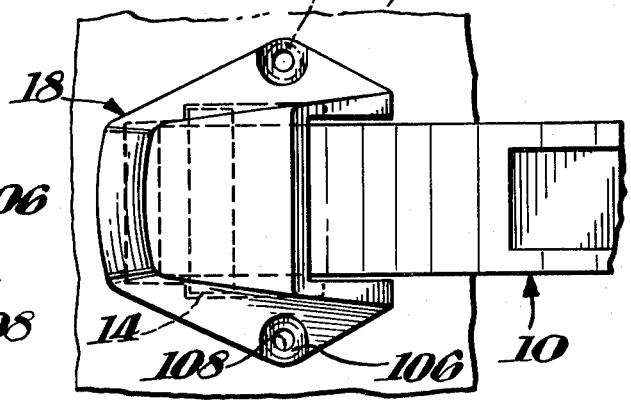
FIG. 16 is a top plan view of yet another handle structure in accordance with this invention.

FIGS. 16–17 show yet another arrangement wherein the form of keepers previously described are completely omitted and the end cover 18 includes a pair of flattened sections 106 having apertures 108 through which threaded fasteners 104 would be inserted for securement to the panel.

The embodiments incorporating such threaded fasteners are still beneficial in that the end cover construction affords greater load capacity. In the preferred form of this invention, however, such threaded fasteners would not be utilized and keepers as aforedescribed would instread provide a quick and easy assembly.

It is further understood that the invention may be practiced for uses other than handles. Thus, for example, fasteners, as previously described, may be utilized for securing any object to a support. In general the object would have legs or extensions similar to the legs on the end covers which would fit through corresponding holes in the support for attachment by the fasteners. Such objects (such as name plates) may be flat, arcuate or any other configuration generally conforming to the shape of the support preferably (although not necessarily) for surface to surface contact.

What is claimed is:

1. A handle for mounting on a panel of a tool box or the like comprising an elongated strap, a pair of lugs at each end of said strap, said lugs in each pair being aligned with each other and extending outwardly from each strap perpendicularly thereto, an end cover for each end of said strap, said end covers being identical with each other, each of said end covers forming a housing with the panel into which a respective pair of said lugs is captured, said housings being open at their ends facing each other and being otherwise closed, keepers formed on each of said end covers for facilitating securement thereto to the panel, a pair of opposed lug nests in opposite sides of said housing parallel to said strap, the sides of said lug nests being spaced apart a distance slightly larger than the distance from the end of one of said lugs to end of the other of said lugs of each of said pair of lugs whereby said lugs may slide in said lug nests, each of said lug nests having an upper wall and having a front wall at said open end of its respective of said end covers, said upper wall and said front wall comprising abutments in the path of inward sliding motion of said lugs to prevent further inward sliding motion of said lugs, and said end covers being of thickened construction in portions thereof in said path of inward sliding motion of said lugs to provide greater load carrying capability of said handle.

2. The handle of claim 1 wherein said keepers comprise a plurality of depending legs integral with said end cover, said legs including a central leg extending from the remote end of said end cover remote from said open end, a corner leg at each corner of said end cover at said open end, each of said corner legs being L-shaped with a vertical portion extending from said end cover and a horizontal portion at the free end thereof, and a horizontal slot extending completely through said central leg for receiving a fastener therein after said legs have been inserted into corresponding openings in the panel.

3. The handle of claim 2, in combination with a fastener, said fastener having a horizontal upper surface, said fastener having a tapered leading edge for insertion into said slot, a channel extending across said fastener adjacent said leading end, the maximum thickness of said leading end at said channel being about the same as the height of said slot, and said fastener terminating in a thickened end adjacent said channel having a thickness greater than said height of said slot whereby said fastener is secured to said central leg at the area of said channel.

4. The handle of claim 2 wherein said vertical portion of each of said corner legs is grooved along the sides thereof facing each other, and the grooves in said corner legs being coplanar with each other.

5. The handle of claim 4, in combination with a fastener, said fastener being a flat-like blade having a lead end dimensioned to fit into said slot and having a pair of deflectable arms for being squeezed together during insertion of said lead end into said slot, and said deflectable arms fitting in said grooves upon termination of the squeezing.

6. The handle of claim 5 wherein said lead end has notches on opposite edges thereof forming stop shoulder which generally abut said central leg when the tip of said lead end is in said slot, the distance between said central leg stop shoulders being greater than the length of said slot, said deflectable arms having notches on their remote edges forming stop shoulders spaced apart a distance greater than the distance between said grooves, and said deflecting arms stop shoulders abutting against said corner legs.

7. The handle of claim 4, in combination with a fastener, said fastener being a flat-like blade having a lead end dimensioned to fit into said slot and having a remote end with a pair of parallel outer edges, said outer edges being notched to create recessed corners with spaced stop shoulders, said corners being dimensioned to permit the ends of said parallel edges to be inserted in said grooves, and said stop shoulders being spaced apart a distance greater than the distance between said grooves for contacting said corner legs.

8. The handle of claim 7 wherein said corner legs are beveled below said grooves to form support members outwardly decreasing in thickness, said outer edges being outer edges of parallel arms, said outer edges being beveled over a length generally corresponding to the length of said grooves, and said parallel arms being connected by a web section of reduced thickness whereby said fastener may be attached to said end cover by inserting said lead end into said central leg slot and said parallel arms are snapped into said grooves.

9. The handle of claim 4, in combination with a fastener, said fastener including a plurality of arms for fitting in said slot and said grooves to comprise temporary confining means for locking said lugs in sid cover end during preassembly whereby said cover ends and said strap form a unit with said fastener on each end cover prior to securement to the panel, and said fastener being detachable to permit reassembly to the panel.

10. The handle of claim 4, in combination with a fastener, said fastener being a generally arrowhead shaped bent wire having a pair of deflectable arms for fitting in said grooves and a lead end for fitting in said slot.

11. The handle of claim 1 including fastening means detachably secured to said keeper, said fastening means comprising temporary confining means for locking said lugs in said end covers during preassembly whereby said end covers and said strap form a unit with said fastening means prior to securement to the panel, and said fastening means being detachable to permit reassembly to the panel.

12. The handle of claim 1 wherein said keepers comprise a plurality of depending legs integral with said end cover for fitting in openings in the panel, said legs including an L-shaped corner leg at each corner of said end cover at said open end, a locking leg at the end of end cover remote from said open end, said locking leg having a generally vertical slot creating bifurcated arms which have remote edges tapering away from each other to provide a leading end insertable into its panel opening, a notch extending across one of said arms for engaging the panel at its opening, and said arms being deflectable to permit said arms to be squeezed together until said notch has entered its opening and to then return to their normal spread apart condition upon termination of the squeezing to lock said end cover to the panel.

13. The handle of claim 1 wherein said keepers comprise a pair of depending L-shaped legs at each corner of said end cover at said open end for fitting in corresponding openings in the panel, and a threaded fastener extending through said end cover at the end remote from said open end.

14. The handle of claim 1 wherein said keepers comprise extensions on said end cover, and threaded fasteners extending through said extensions.

15. The handle of claim 1 wherein said lug nests are bowed in toward each other at their lower ends, and said lower ends being separated by a distance less than the maximum distance between the remote faces of said lugs whereby said lugs are confined in said end covers and form a unit therewith during preassembly.

16. The handle of claim 15 wherein said remote faces are rounded to comprise cams for spreading apart said lower ends during insertion of said lugs into said end cover.

17. The handle of claim 1 wherein said end cover increases in thickness toward said open end, the top wall of said end cover being upwardly inclined toward said open end to form a thickened corner where said upper wall and said front wall of said lug nests meet.

18. The handle of claim 17 wherein the front face of said end cover at said open end is outwardly inclined away from said top wall.

19. A handle for mounting on a panel of a tool box or the like comprising an elongated strap, a pair of lugs at each end of said strap, said lugs in each pair being aligned with each other and extending outwardly from said strap perpendicularly thereto, an end cover for each end of said strap, said end covers being identical with each other, said end covers forming a housing with the panel into which a respective pair of said lugs is captured, said housings being open at their ends facing each other and being otherwise closed, keepers formed on each of said end covers for facilitating securement thereto to the panel, a pair of opposed lug nests in opposite sides of said housing parallel to said strap, the sides of said lug nests being spaced apart a distance slightly larger than the distance from the end of one of said lugs to end of the other of said lugs of each of said pair of lugs whereby said lugs may slide in said lug nests, each of said lug nests having an upper wall and having a front wall at said open end of its respective said end covers, said upper wall and said front wall comprising abutments in the path of inward sliding motion of said lugs to prevent further inward sliding motion of said lugs, said keepers comprising a plurality of depending legs integral with said end cover, said legs including a central leg extending from the remote end of said end cover remote from said open end, a corner leg at each corner of said end cover at said open end, each of said corner legs being L-shaped with a vertical portion extending from said end cover and a horizontal portion at the free end thereof, and a slot extending completely through said central leg for facilitating the fastening of said end cover to the panel after said legs have been inserted into corresponding openings in the panel.

20. The handle of claim 19 wherein said vertical portion of each of said corner legs is grooved along the sides thereof facing each other, and the grooves in said corner legs being coplanar with each other.

21. The handle of claim 20, in combination with a fastener, said fastener being a generally arrowhead shaped bent wire having a pair of deflectable arms for fitting in said grooves and a lead end for fitting in said slot.

22. The handle of claim 20 wherein said slot is horizontal, in combination with a fastener, said fastener being a flat-like blade having a lead end dimensioned to fit into said slot and having a pair of deflectable arms for being squeezed together during upon insertion of said lead end into said slot, and said deflectable arms fitting in said grooves upon termmination of the squeezing.

23. The handle of claim 22 wherein said lead end has notches on opposite edges thereof forming stop shoulder which generally abut said central leg when the tip of said lead end is in said slot, the distance between said central leg stop shoulders being greater than the length of said slot, said deflectable arms having notches on their remote edges forming stop shoulders spaced apart a distance greater than the distance between said grooves, and said deflecting arms stop shoulders abutting against said corner legs.

24. The handle of claim 20 wherein said slot is horizontal, in combination with a fastener, said fastener being a flat-like blade having a lead end dimensioned to fit into said slot and having a remote end with a pair of parallel outer edges, said outer edges being notched to create recessed corners with spaced stop shoulders, said corners being dimensioned to permit the ends of said parallel edges to be inserted in said grooves, and said stop shoulders being spaced apart a distance greater than the distance between said grooves for contacting said corner legs.

25. The handle of claim 24 wherein said corner legs are beveled below said grooves to form support members outwardly decreasing in thickness, said outer edges being outer edges of parallel arms, said outer edges being beveled over a length generally corresponding to the length of said grooves, and said parallel arms being connected by a web section of reduced thickness whereby said gastener may be attached to said end cover by inserting said lead end into said central leg slot and said parallel arms are snapped into said grooves.

26. The handle of claim 20 wherein said slot is horizontal, in combination with a fastener, said fastener including a plurality of arms for fitting in said slot and said grooves to comprise temporary confining means for locking said lugs in said cover end during preassembly whereby said cover ends and said strap form a unit with said fastener on each of cover ends prior to securement to the panel, and said fastener being detachable to permit reassembly to the panel.

27. The handle of claim 20 wherein said slot is vertical creating bifurcated arms which have remote edges tapering away from each other to provide a leading end insertable into its panel opening, a notch extending across one of said arms for engaging the panel at its opening, and said arms being deflectable to permit said arms to be squeezed together until said notch has entered its opening and to then return to their normal spread apart condition upon termination of the squeezing to lock said end cover to the panel.

28. The handle of claim 19 wherein said slot is horizontal, in combination with a fastener, said fastener having a horizontal upper surface, said fastener having a tapered leading edge for insertion into said slot, a channel extending across said fastener adjacent said leading end, the maximum thickness of said leading end at said channel being about the same as the height of said slot, and said fastener terminating in a thickened end adjacent said channel having a thickness greater than said height of said slot whereby said fastener is secured to said central leg at the area of said channel.

29. The handle of claim 19 wherein said lug nests are bowed in toward each other at their lower ends, and said lower ends being separated by a distance less than the maximum distance between the remote faces of said lugs whereby said lugs are confined in said end covers and form a unit therewith during preassembly.

30. The handle of claim 29 wherein said remote faces are rounded to comprise cams for spreading apart said lower ends during insertion of said lugs into said end cover.

31. An arrangement for mounting an object to a support comprising, in combination, a pair of remote legs extending from the face of said object disposed toward said support, said face further having a central leg remote from said remote legs, a plurality of holes extending through said support through which said remote legs and said central leg may be inserted to extend through said support and be exposed on the remote side of said support, each of said remote legs having a portion thereof exposed from said remote face of said support and perpendicular thereto, said portions being grooved along the sides thereof facing each other, said central leg extending through its said hole in said support, a slot in said central leg exposed on said remote side, a generally flat fastener, said fastener having a pair of deflectable arms disposed in the grooves of said portions, said fastener having a lead end disposed in said slot of said central leg, and said fastener being engaged in said slot and in said grooved portions with said support between said fastener and said object face to provide a spaced, triangular multi-point locking of said object to said support.

32. An arrangement for mounting an object to a support comprising, in combination, said object having a body portion for being on one side of the support, a pair of L-shaped legs extending away from said body portion for being inserted through corresponding holes in the support whereby the free ends of said legs may be disposed against the support on the side thereof opposite said body portion, a central leg extending away from said body portion disposed remote from and between said L-shaped legs for fitting through a further corresponding opening in the support, said central leg being slotted, and fastening means on said central leg for acting against the support to cooperate with said L-shaped legs in providing multi-point spaced triangular mounting of said object to the support at said L-shaped legs and said central legs.

33. The arrangement of claim 32 wherein said L-shaped legs have grooves on the sides of said legs facing each other, the slot in said central leg being transverse said central leg and being generally coplanar with said grooves, and said fastening means including a single fastener disposed in said grooves and said slot.

34. The arrangement of claim 33 wherein said fastener is a generally arrowhead shaped flat plate having a pair of deflectable arms for fitting in said grooves and a lead end for fitting in said slot.

35. The arrangement of claim 33 wherein said fastener is a generally arrowhead shaped bent wire having a pair of deflectable arms for fitting in said grooves and a lead end for fitting in said slot.

36. The arrangment of claim 33 wherein said fastener is a generally arrowhead shaped flat plate having opposed sides for fitting in said grooves and a lead end for fitting in said slot.

37. The arrangement of claim 32 wherein the slot in said central leg is transverse said central leg generally coplanar with the upper support contacting surfaces of the free ends of said L-shaped legs, said fastening means comprising a fastener having a horizontal upper surface, said fastener having a tapered leading edge for insertion into said slot, a channel extending across said fastener adjacent said leading end, the maximum thickness of said leading end at said channel being about the same as the height of said slot, and said fastener terminating in a thickened end adjacent said channel having a thickness greater than said height of said slot whereby said fastener is secured to said central leg at the area of said channel.

38. The arrangement of claim 32 wherein the slot of said central leg is longitudinal of said central leg creating bifurcated arms which have remote edges tapering away from each other to provide a leading end insertable into an opening in the support, said fastening means comprising a notch extending across one of said arms for engaging the support at its opening, and said arms being deflectable to permit said arms to be squeezed together until said notch has entered its opening and to then return to their normal spread apart condition upon termination of the squeezing to lock said object to the support.

39. An end cover for securing a handle to a panel of a tool box or the like comprising a dished out body member for forming a housing with the panel into which a respective pair of lugs is captured, said member being open at one end and open at its floor and being otherwise closed, keepers formed on said floor and extending away therefrom for facilitating securement thereto to the panel, a pair of opposed lug nests in opposite sides of said housing on each side of said open end, the sides of said lug nests being spaced apart whereby the lugs may slide in said lug nests, each of said lug nests having an upper wall and having a front wall at said open end, said upper wall and said front wall comprising abutments to be in the path of inward sliding motion of the lugs to prevent further inward sliding motion of the lugs, said end cover being of thickened construction in portions thereof in said path of inward sliding motion of the lugs to provide gerater load carrying capability of the handle, said keepers comprising a plurality of depending legs integral with said end cover, said legs including a central leg extending from the remote end of said end cover remote from said open end, a corner leg at each corner of said end cover at said open end, each of said corner legs being L-shaped with a vertical portion extending from said end cover and a horizontal portion at the free end thereof, and a horizontal slot extending completely through said central leg for receiving a fastener therein after said legs have been inserted into corresponding openings in the panel.

40. The end cover of claim 39 wherein said L-shaped legs are provided with grooves on the sides of said L-shaped legs facing each other, and said grooves being coplanar with each other and with said slot.

41. An end cover for securing a handle to a panel of a tool box or the like comprising a dished-out body member for forming a housing with the panel into which a respective pair of lugs is captured, said member being open at one end and open at its floor and being otherwise closed, keepers formed on said floor and extending away therefrom for facilitating securement thereto to the panel, a pair of opposed lug nests in opposite sides of said housing on each side of said open end, the sides of said lug nests being spaced apart whereby the lugs may slide in said lug nests, each of said lug nests having an upper wall and having a front wall at said open end, said upper wall and said front wall comprising abutments to be in the path of inward sliding motion of the lugs to prevent further inward sliding motion of the lugs, said end cover being of thickened construction in portions thereof in said path of inward sliding motion of the lugs to provide greater load carrying capability of the handle, said keepers comprising a plurality of depending legs integral with said end cover, said legs including a central leg extending from the remote end of said end cover remote from said open end, a corner leg at each corner of said end cover at said open end, each of said corner legs being L-shaped with a vertical portion extending from said end cover and a horizontal portion at the free end thereof, a locking leg at the end of said end cover remote from said open end, said locking leg having a generally vertical slot creating bifurcated arms which have remote edges tapering away from each other to provide a leading end insertable into its panel opening, a notch extending across one of said arms for engaging the panel at its opening, and said arms being deflectable to permit said arms to be squeezed together until said notch has entered its opening and to then return to their normal spread apart condition upon termination of the squeezing to lock said end cover to the panel.

* * * * *